US008887389B2

(12) United States Patent
Wei

(10) Patent No.: US 8,887,389 B2
(45) Date of Patent: Nov. 18, 2014

(54) METHOD FOR WINDING WIRE OF ELECTRICAL CONNECTOR

(75) Inventor: Kuan-Hsiung Wei, Taipei (TW)

(73) Assignee: Shyh-Chang Chiu, Taipei (TW)

( * ) Notice: Subject to any disclaimer, the term of this patent is extended or adjusted under 35 U.S.C. 154(b) by 838 days.

(21) Appl. No.: 13/152,291

(22) Filed: Jun. 3, 2011

(65) Prior Publication Data

US 2012/0304462 A1 Dec. 6, 2012

(51) Int. Cl.
*H01R 43/00* (2006.01)
*H01F 41/06* (2006.01)
*H01F 27/28* (2006.01)

(52) U.S. Cl.
CPC ..... *H01F 41/0629* (2013.01); *H01F 27/2895* (2013.01); *H01F 2027/2838* (2013.01)
USPC ..... 29/872; 29/605; 336/170; 336/229

(58) Field of Classification Search
CPC ..... H01F 41/008; H01F 41/629; H01F 19/06; H01F 30/16
USPC ..... 29/602.1, 605, 606, 868, 872; 336/170, 336/182, 229, 232
See application file for complete search history.

(56) References Cited

U.S. PATENT DOCUMENTS

| | | | | |
|---|---|---|---|---|
| 1,133,750 | A * | 3/1915 | Shaw | 336/170 |
| 5,182,537 | A * | 1/1993 | Thuis | 336/180 |
| 2007/0040645 | A1 * | 2/2007 | Sedio et al. | 336/232 |

* cited by examiner

*Primary Examiner* — Donghai D Nguyen
(74) *Attorney, Agent, or Firm* — Leong C. Lei

(57) ABSTRACT

The present invention relates to a method for winding wires of electrical connector, which includes adopting a unique process to wind wires around a ring body, wherein first and second wire groups each including four different color wires are respectively wound around upper and lower half portions of the ring body and respectively forming first and second input terminal wires and first and second output terminal wires. The first and second input terminal wires are twisted with corresponding ones to thereby achieve reduction of reluctance and better application to high frequency signals.

4 Claims, 8 Drawing Sheets

METHOD FOR WINDING WIRE OF ELECTRICAL CONNECTOR

TECHNICAL FIELD OF THE INVENTION

The present invention generally relates to a method for winding wire of electrical connector, and more particularly to a method for winding wire of electrical connector that reduces magnetic reluctance for better application to high frequency signals.

DESCRIPTION OF THE PRIOR ART

A conventional transmission line transformer is an impedance transformer constructed with the operation principles of transmission line and transformer. The impedance transformer is simply a combination of a distributed parameter circuit that is commonly referred to as a transmission line and a lumped parameter circuit that is commonly referred to as a coil, and is, in brief, a transformer constructed by winding a transmission line around a high-permeability and low-loss core. For example, to manufacture a commonly used network transformer, electrical wires of four different colors are first twisted with each other at a middle section thereof and the twisted wires are wound around a ring-shaped ferrite core by a predetermined number of turns. The winding of the wires is made within an angular range of 180-270 degrees in a circumferential direction of the ring-shaped ferrite core. This process of winding wire has been commonly used for years and is a simple process of manufacturing. Products manufactured in this way are currently used in transmitting and receiving signal for Ethernet 10/100 Base-T or 1000 Base-T. However, such a commonly use way of wire winding requires manually winding wires, which makes it hard to realize precise control of wire winding. Further, due to the manufacturing being simple, the characteristics and quality of the transformers so made through a mass production process may get inconsistent. Consequently, it becomes impossible to realize signal transmission for high speed transmission.

Due to the fast development and progress of science and technology the manufacturers of network RJ connectors are now devoted themselves to the development of new RJ connectors for transmission of 10G signal. However, the conventional way of manufacturing transforms for the transmission of network signal is to wind wires around a ring-shaped ferrite core, and it is mentioned previous that the transformers manufactured with the conventional method are incapable of application to high frequency. Due to such a reason, those manufacturers that are capable of manufacturing RJ connectors for 10G signal transmission apply the skin effect that occurs when a transmission line transmits high frequency signals by winding two cables of four-color twisted wires around a dual-bore ring-shaped ferrite core or a conventional ring-shaped ferrite core by a predetermined number of turns.

However, the method of winding two cables of four-color twisted wires around a dual-hole ring-shaped ferrite core or a conventional ring-shaped ferrite core still shows the following drawbacks, which are desired to be further improved:

Winding of wire is carried out manually, so that care must be exercised in controlling the art and quality, and thus it is difficult to realize high productivity in mass production.

SUMMARY OF THE INVENTION

The primary objective of the present invention is to wind wires around a ring-shaped body through a specific process so as to realize consistent high quality and improved yield rate of the products, and also reducing reluctance for better application to high frequency signals.

To achieve the above objective, the present invention provides a method for wire winding, which begins with a step of providing four wires of different colors and arranging and twisting the wires to have a middle section thereof twisted together to form a first wire group, which has two ends respectively forming first input terminal wires and first output terminal wires each comprising four wires. Further, additional four wires of different colors are provided, which are arranged and twisted to have a middle section thereof twisted together to form a second wire group, which has two ends respectively forming second input terminal wires and second output terminal wires each comprising four wires. Afterwards, a ring body is provided to allow the first wire group to be wound around an upper half portion (within an angular range of around 180 degrees) of the ring body and also to allow the second wire group to be wound around a lower half portion (within an angular range of around 180 degrees) of the ring body. After the operations, at the side of the ring body where the first and second input terminal wires are located, each of the first input terminal wires and the corresponding one of the second input terminal wires are twisted and the twisted wires are arranged to form third input terminal wires. At the opposite side of the ring body, each of the first output terminal wires and the corresponding one of the second output terminal wires are twisted and the twisted wires are arranged to form third output terminal wires. Afterwards, one input terminal wire of the third input terminal wires is twisted with one output terminal wire of the third output terminal wires and the remaining wires are displaced and re-arranged to form three fourth input terminal wires; and at the opposite side, one output terminal wire of the third output terminal wires is twisted with one input terminal wire of the third input terminal wires, while the remaining wires are displaced and re-arranged to form three fourth output terminal wires. This completes the wire winding method of electrical connector according to the present invention.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
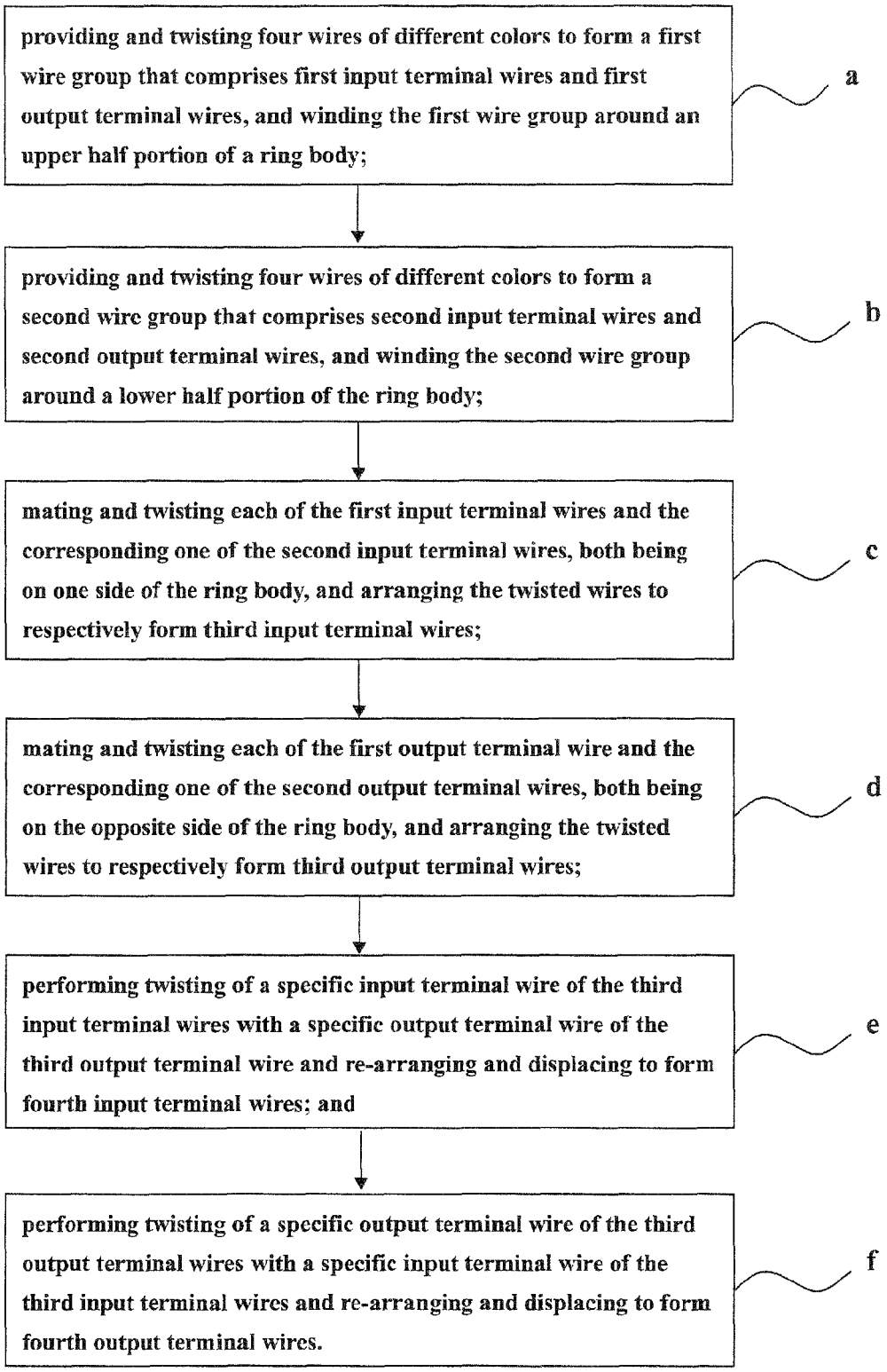
FIG. 1 is a flowchart showing a wire winding method according to a preferred embodiment of the present invention.
Figure 2:
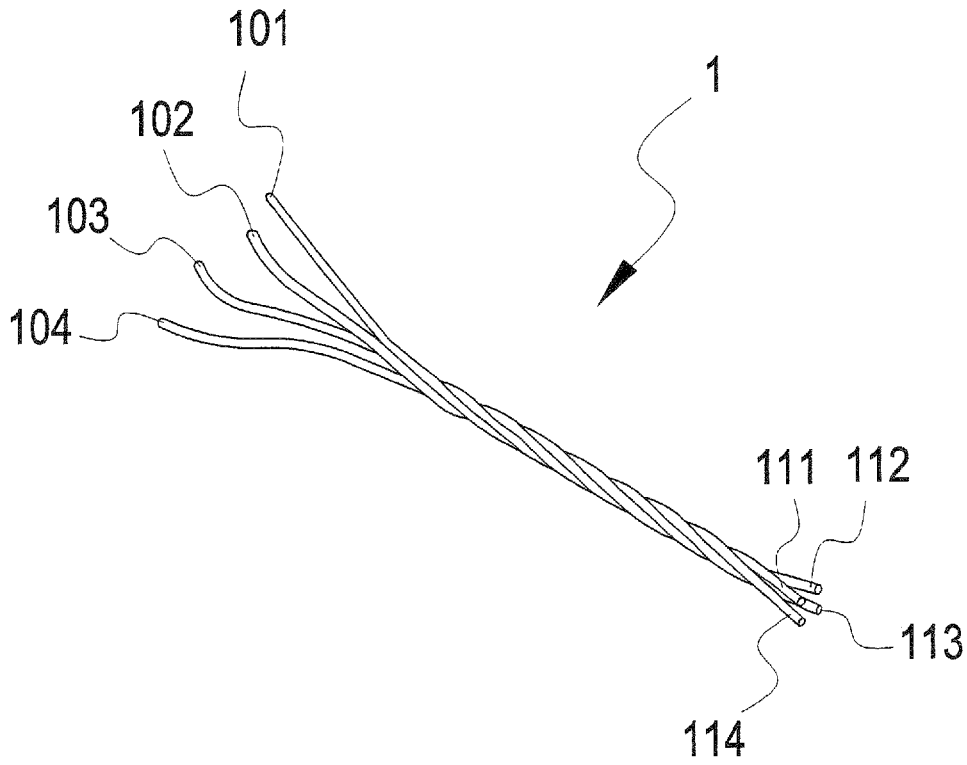
FIG. 2 is a first schematic view illustrating a wire winding operation according to the method of the present invention.
Figure 3:
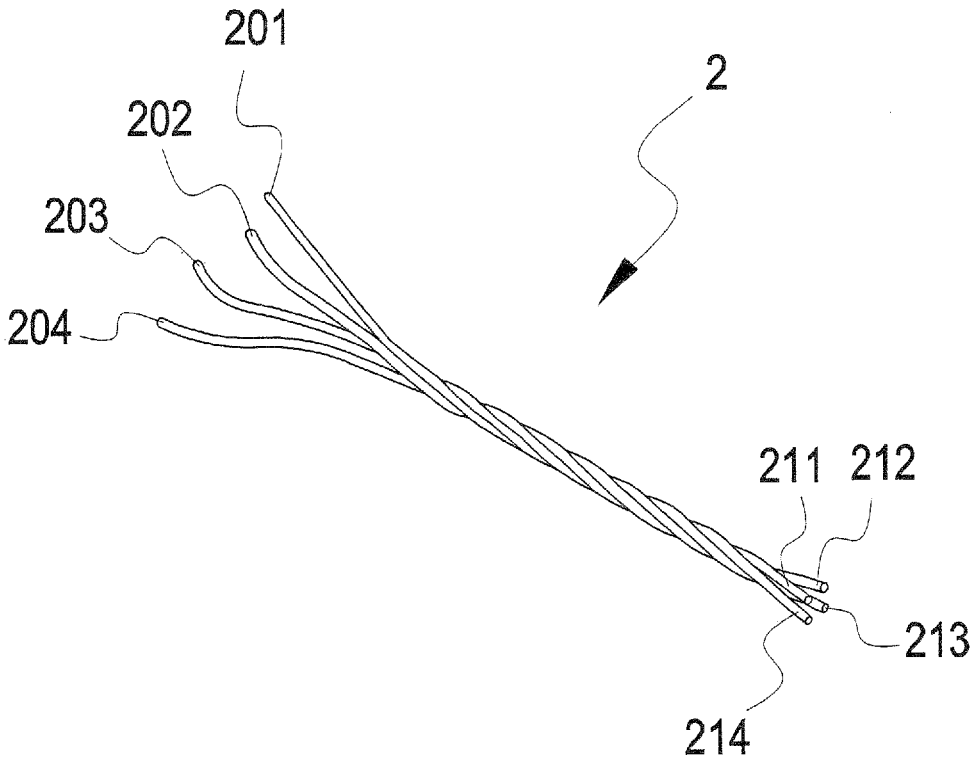
FIG. 3 is a second schematic view illustrating the wire winding operation according to the method of the present invention.
Figure 4:
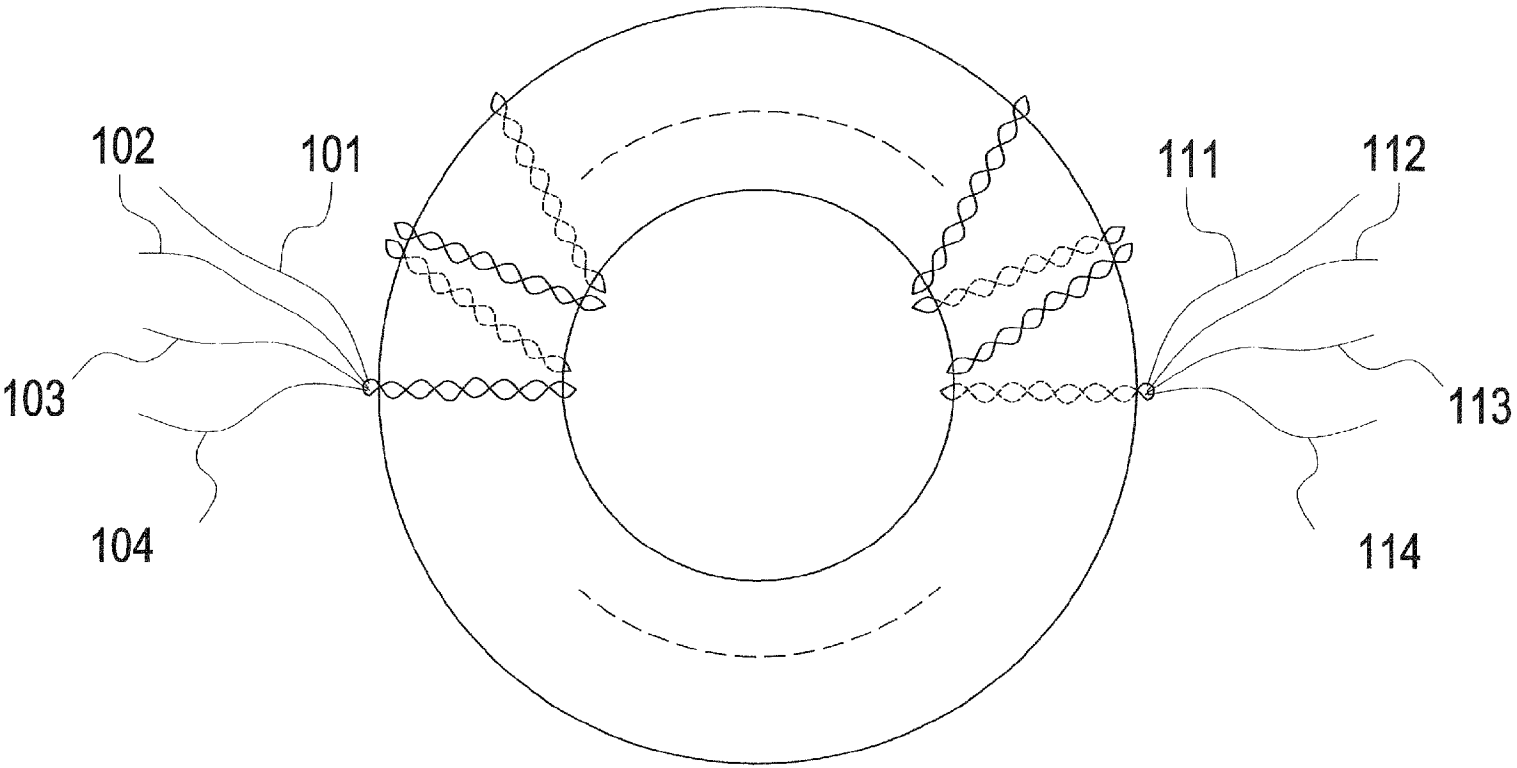
FIG. 4 is a third schematic view illustrating the wire winding operation according to the method of the present invention.
Figure 5:
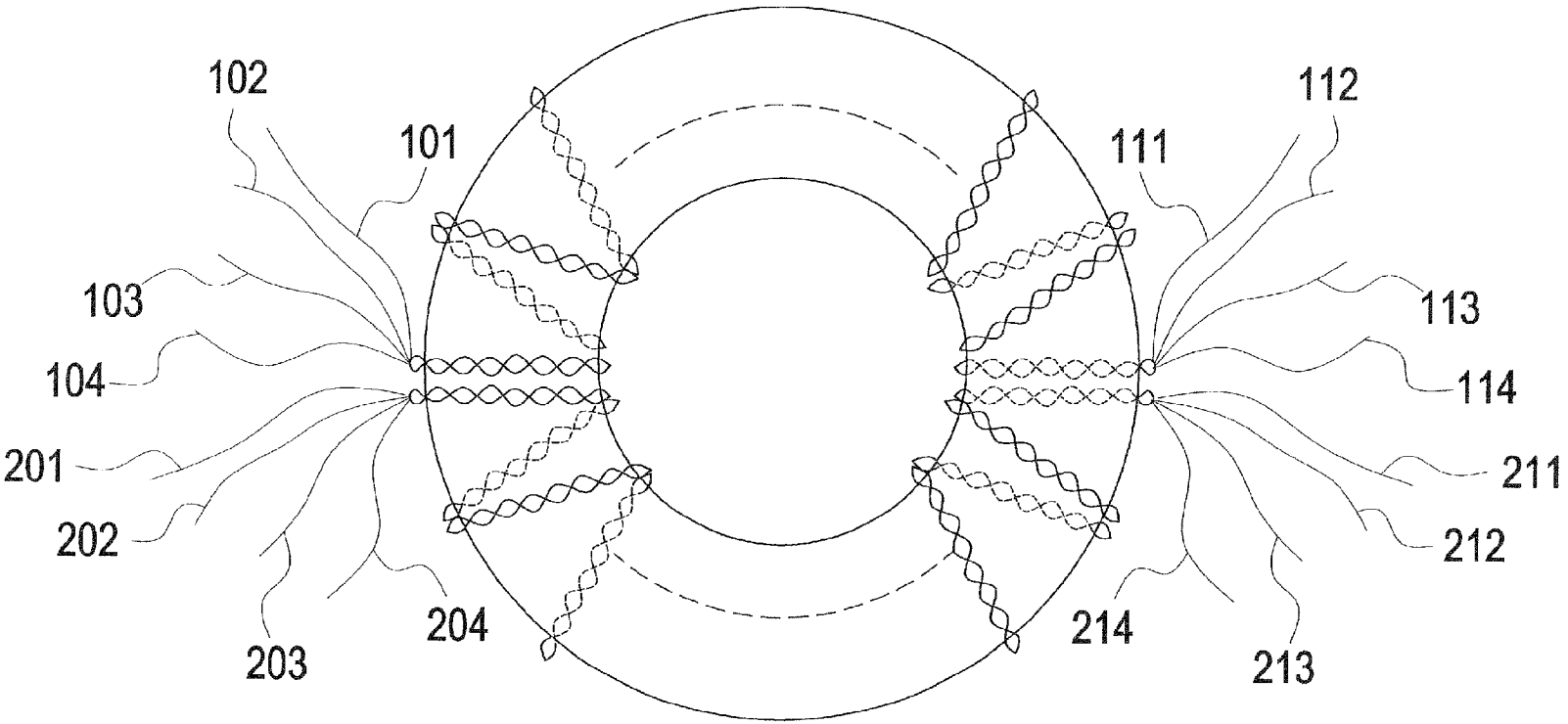
FIG. 5 is a fourth schematic view illustrating the wire winding operation according to the method of the present invention.
Figure 6:
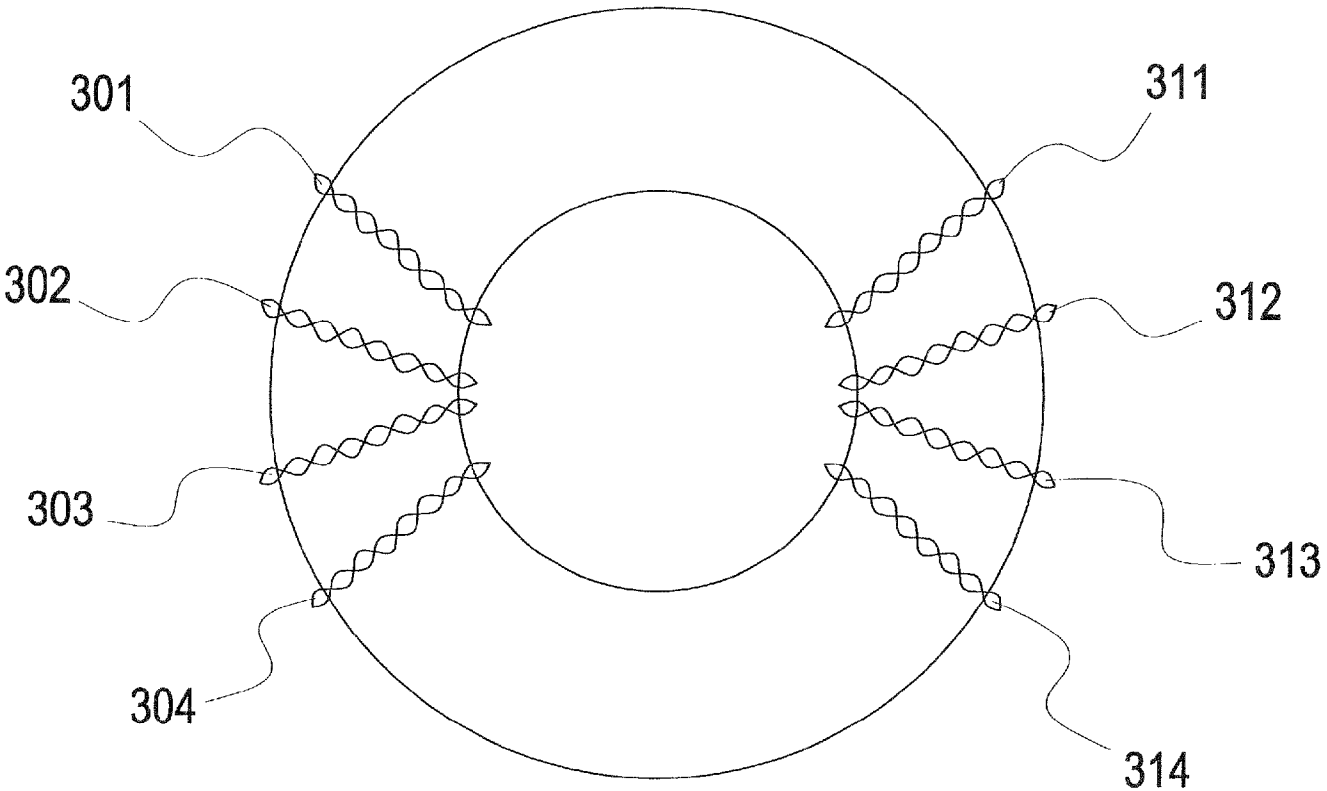
FIG. 6 is a fifth schematic view illustrating the wire winding operation according to the method of the present invention.
Figure 7:
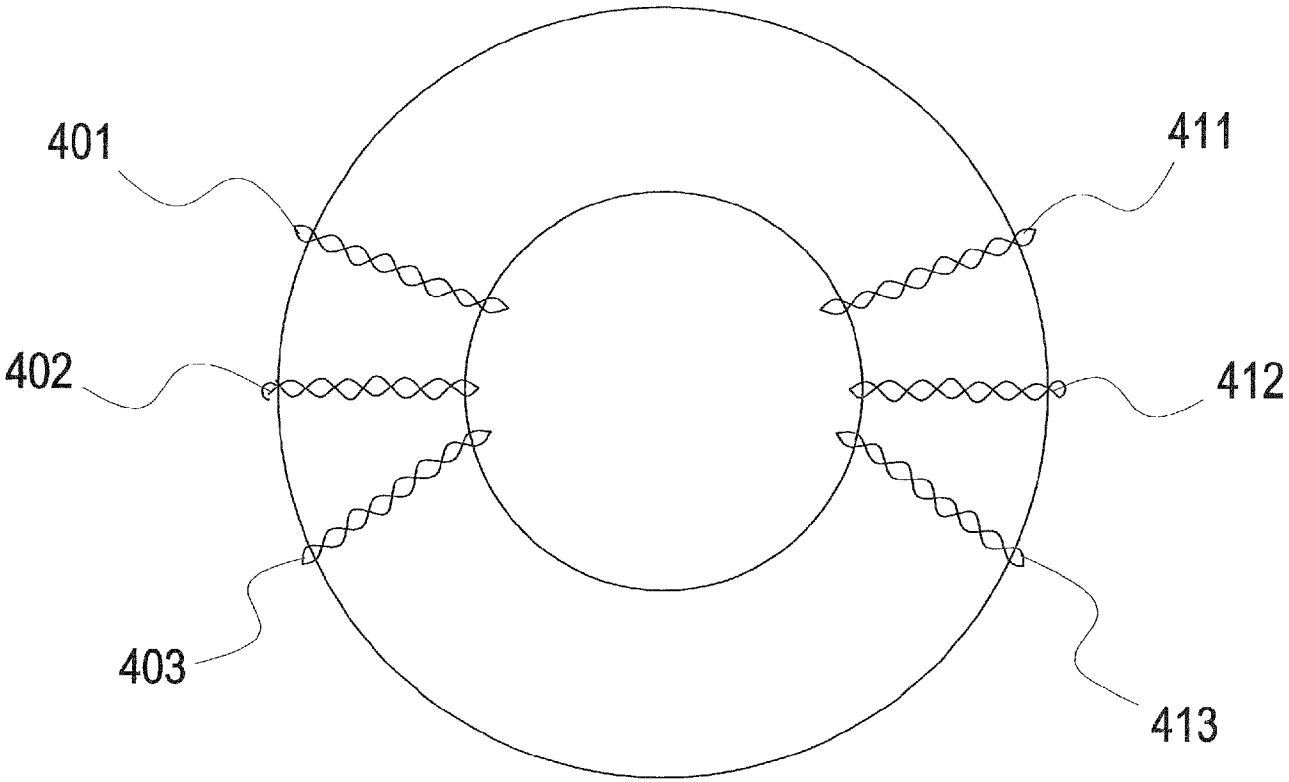
FIG. 7 is a sixth schematic view illustrating the wire winding operation according to the method of the present invention.

Referring to FIG. 1, which shows a flowchart of a wire winding method according to a preferred embodiment of the present invention, the drawing clearly shows that the wire winding method according to the present invention comprises the following steps:

(a) providing and twisting four wires of different colors to form a first wire group that comprises first input terminal wires and first output terminal wires, and winding the first wire group around an upper half portion of a ring body;

(b) providing and twisting four wires of different colors to form a second wire group that comprises second input terminal wires and second output terminal wires, and winding the second wire group around a lower half portion of the ring body;

(c) mating and twisting each of the first input terminal wires and the corresponding one of the second input terminal wires, both being on one side of the ring body, and arranging the twisted wires to respectively form third input terminal wires;

(d) mating and twisting each of the first output terminal wire and the corresponding one of the second output terminal wires, both being on the opposite side of the ring body, and arranging the twisted wires to respectively form third output terminal wires;

(e) performing twisting of a specific input terminal wire of the third input terminal wires with a specific output terminal wire of the third output terminal wire and re-arranging and displacing to form fourth input terminal wires; and (f) performing twisting of a specific output terminal wire of the third output terminal wires with a specific input terminal wire of the third input terminal wires and re-arranging and displacing to form fourth output terminal wires.

Further, the ring body around which the wires are wound comprises a ring-shaped ferrite core.

Referring to FIGS. 2-7, which are schematic views illustrating a wire winding operation according to the present invention, these drawings clearly show that the above described steps are more clearly illustrated. Firstly, four wires of different colors are twisted to form a first wire group 1. The first wire group 1 has two ends respectively comprising four first input terminal wires 101, 102, 103, 104 and four first output terminal wires 111, 112, 113, 114. Further, four additional wires of different colors are twisted to form a second wire group 2. The second wire group 2 has two ends respectively comprising four second input terminal wires 201, 202, 203, 204 and four second output terminal wires 211, 212, 213, 214 (see FIGS. 2 and 3). The first wire group 1 and the second wire group 2 are then respectively wound around upper and lower half portions of a ring body with the first input terminal wires 101, 102, 103, 104, the first output terminal wires 111, 112, 113, 114, the second input terminal wires 201, 202, 203, 204, and the second output terminal wires 211, 212, 213, 214 extending outside the ring body (see FIGS. 4 and 5). Afterwards, the first input terminal wire 101 and the second input terminal wire 201 are twisted to form a third input terminal wire 301; the first input terminal wire 102 and the second input terminal wire 202 are twisted to form a third input terminal wire 302; the first input terminal wire 103 and the second input terminal wire 203 are twisted to form a third input terminal wire 303; and the first input terminal wire 104 and the second input terminal wire 204 are twisted to form a third input terminal wire 304; and after the twisting operations, the twisted wires are properly arranged. Further, at the opposite side of the ring body, the first output terminal wire 111 and the second output terminal wire 211 are twisted to form a third output terminal wire 311; the first output terminal wire 112 and the second output terminal wire 212 are twisted to form a third output terminal wire 312; the first output terminal wire 113 and the second output terminal wire 213 are twisted to form a third output terminal wire 313; and the first output terminal wire 114 and the second output terminal wire 214 are twisted to form a third output terminal wire 314; and after the twisting operations, the twisted wires are properly arranged (see FIG. 6). After the above operations, the third input terminal wire 302 and the third output terminal wire 311 are twisted to form a fourth input terminal wire 402. The third input terminal wire 301 is re-named as a fourth input terminal wire 401, after the twisting of the third input terminal wire 302 and the third output terminal wire 311. The third output terminal wire 312 is displaced to the same side of the ring body as the fourth input terminal wire 401 and re-named as a fourth input terminal wire 403. Further, the third input terminal wire 303 is displaced to the side of the ring body that is opposite to the fourth input terminal wire 401 and is re-named as a fourth output terminal wire 411. The third output terminal wire 313 and the third input terminal wire 304 are twisted to form a fourth output terminal wire 412. The third output terminal wire 314 is re-named as a fourth output terminal wire 413 (see FIG. 7).

Figure 8:
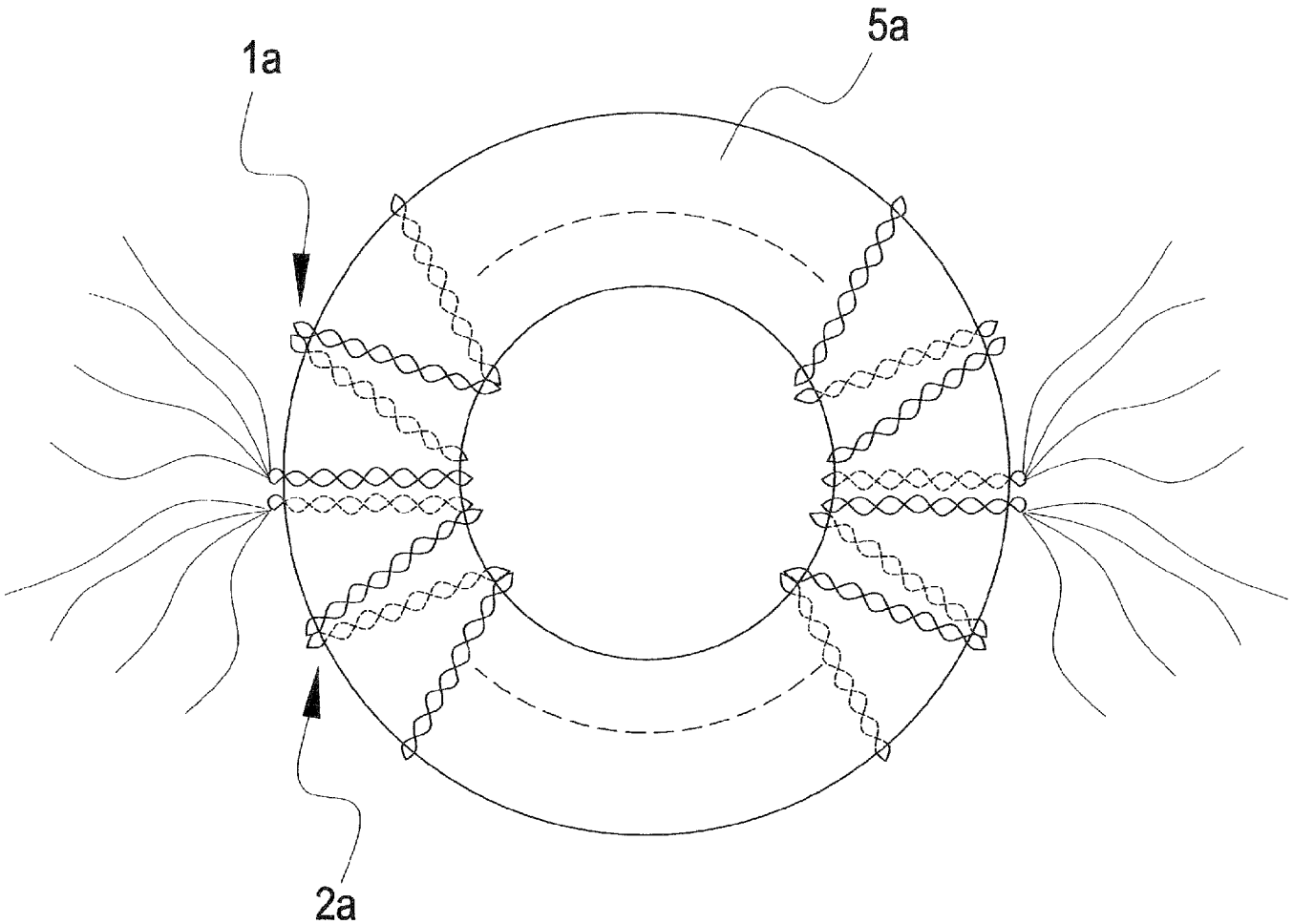
FIG. 8 schematically illustrates a wire winding method according to another embodiment of the present invention.

Referring to FIG. 8, a wire winding method according to another embodiment of the present invention is illustrated. The drawing clearly shows that a first wire group 1*a* is wound around a ring body 5*a* in such a way that the winding starts from a major surface (the surface facing outside the drawing plane or upper surface) of the ring body 5*a* at one side, going down to an opposite major surface (the surface facing inside the drawing plane or lower surface) of the ring body 5*a*, and the winding terminates at the lower surface of the ring body 5*a* at the opposite side; and a second wire group 2*a* is wound around the ring body 5*a* in such a way that the winding starts from the lower surface of the ring body 5*a* at the one side, going up to the upper surface of the ring body 5*a*, and the winding terminates at the upper surface of the ring body 5*a*. (It is noted in the drawing that dashed lines indicate being located below the ring body and thus at the lower surface, while the solid lines indicate being located above the ring body and thus at the upper surface).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A method for winding wire of electrical connector, comprising the following steps:

(a) providing and twisting four wires of different colors to form a first wire group that comprises first input terminal wires and first output terminal wires, and winding the first wire group around an upper half portion of a ring body;

(b) providing and twisting four wires of different colors to form a second wire group that comprises second input terminal wires and second output terminal wires, and winding the second wire group around a lower half portion of the ring body;

(c) mating and twisting each of the first input terminal wires and the corresponding one of the second input terminal wires, both being on one side of the ring body, and arranging twisted wires having the input terminal wires twisted therein to respectively form third input terminal wires;

(d) mating and twisting each of the first output terminal wire and the corresponding one of the second output terminal wires, both being on the opposite side of the ring body, and arranging twisted wires having the output terminal wires twisted therein to respectively form third output terminal wires;

(e) performing twisting of a specific input terminal wire of the third input terminal wires with a specific output terminal wire of the third output terminal wire and re-arranging and displacing to form fourth input terminal wires; and (f) performing twisting of a specific output terminal wire of the third output terminal wires with a specific input terminal wire of the third input terminal wires and re-arranging and displacing to form fourth output terminal wires.

2. The method according to claim 1, wherein the ring body comprises a ring-shaped ferrite core.

3. The method according to claim 1, wherein the fourth input terminal wires comprise three sets of wires that are formed through combination and twisting.

4. The method according to claim 1, wherein the fourth output terminal wires comprise three sets of wires that are formed through combination and twisting.

* * * * *